US006626077B1

(12) United States Patent
Gilbert

(10) Patent No.: US 6,626,077 B1
(45) Date of Patent: Sep. 30, 2003

(54) INTERCEPT VEHICLE FOR AIRBORNE NUCLEAR, CHEMICAL AND BIOLOGICAL WEAPONS OF MASS DESTRUCTION

(76) Inventor: Mark David Gilbert, 907 15th Ave., Apt 7, Tuscaloosa, AL (US) 35401

( * ) Notice: Subject to any disclaimer, the term of this patent is extended or adjusted under 35 U.S.C. 154(b) by 0 days.

(21) Appl. No.: 10/271,649

(22) Filed: Oct. 16, 2002

(51) Int. Cl.[7] ..... B64D 1/04

(52) U.S. Cl. ..... 89/1.11; 89/1.34; 102/400; 102/405; 102/504

(58) Field of Search ..... 89/1.11, 1.1, 1.34; 102/400, 405, 504

(56) References Cited

U.S. PATENT DOCUMENTS

| | | | | |
|---|---|---|---|---|
| 2,365,778 A | | 12/1944 | Schwab | 89/1 |
| 4,231,311 A | | 11/1980 | Longerich | 114/244 |
| 5,069,109 A | * | 12/1991 | Lavan, Jr. | 89/1.11 |
| 5,583,311 A | | 12/1996 | Reiger | 89/1.11 |
| 5,691,502 A | | 11/1997 | Craddock et al. | 102/494 |
| 5,710,423 A | | 1/1998 | Biven et al. | 244/3.1 |
| 5,750,918 A | * | 5/1998 | Mangolds et al. | 102/502 |
| 5,811,788 A | | 9/1998 | Wicke | 244/3.1 |
| 5,866,837 A | | 2/1999 | Biven et al. | 89/1.11 |
| 5,936,229 A | | 8/1999 | Livingston | 290/203.2 |
| 6,231,002 B1 | | 5/2001 | Hibma et al. | 244/3.22 |
| 6,260,797 B1 | | 7/2001 | Palmer | 244/49 |

FOREIGN PATENT DOCUMENTS

| | | |
|---|---|---|
| EP | 0175914 | 2/1986 |
| FR | 859282 | * 12/1940 |

OTHER PUBLICATIONS

Theodore A. Postol, "Why Missile Defense Won't Work" MIT Technology Review, Apr. 2002 Issue.
THAAD: In the Eye of the Storm, by J.R. Wilson ©1996 Defense Web Online Publication.
Dept of Defense Press Release, Mar. 29, 1999 "THAAD Test Flight does not Achieve Intercept Target".
SGT. 1st Class Connie E. Dickey, Army News Svcs. May 13, 1998 "THAAD to Defend Against Ballistic Missile Attacks".
Unknown Author—Short Description of THAAD by Lockheed Martin Space & Missiles GRP. ©2002.
Postol vs. the Pentagon, by Gary Taubes MIT Technology Review, Apr. 2002 Issue.

* cited by examiner

*Primary Examiner*—J. Woodrow Eldred

(57) ABSTRACT

An intercept device for flying objects made of a lightweight, packable structure made of a pliable, tear resistant material that can be expanded to a large web-like structure by means of a deployment device, into the path of a flying weapon. To capture, hold and reduce the velocity of intercepted flying objects, activatable resistance bodies are incorporated into uniformly distributed masses that are connected to the perimeter of the web like structure. Contractable sections of the web, made of cable-like structures, connected to perimeter masses, act as drawstrings upon collision with flying object. This causes closure of the web around the flying object as a result of the mass's inertia and added resistance from deployable resistance structures that place tension on drawstring structures of the web. The flying object is subsequently captured within the web, held secure and it's velocity rapidly reduced.

1 Claim, 4 Drawing Sheets

FIG. 3
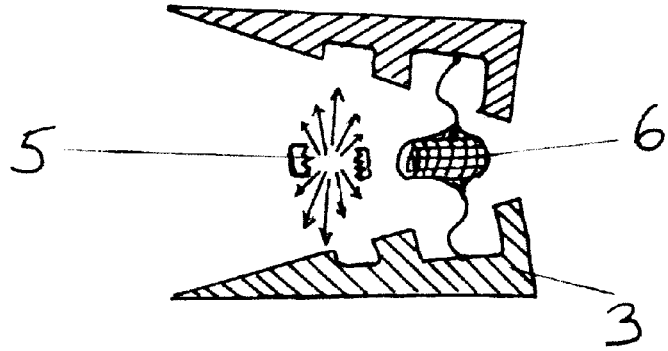
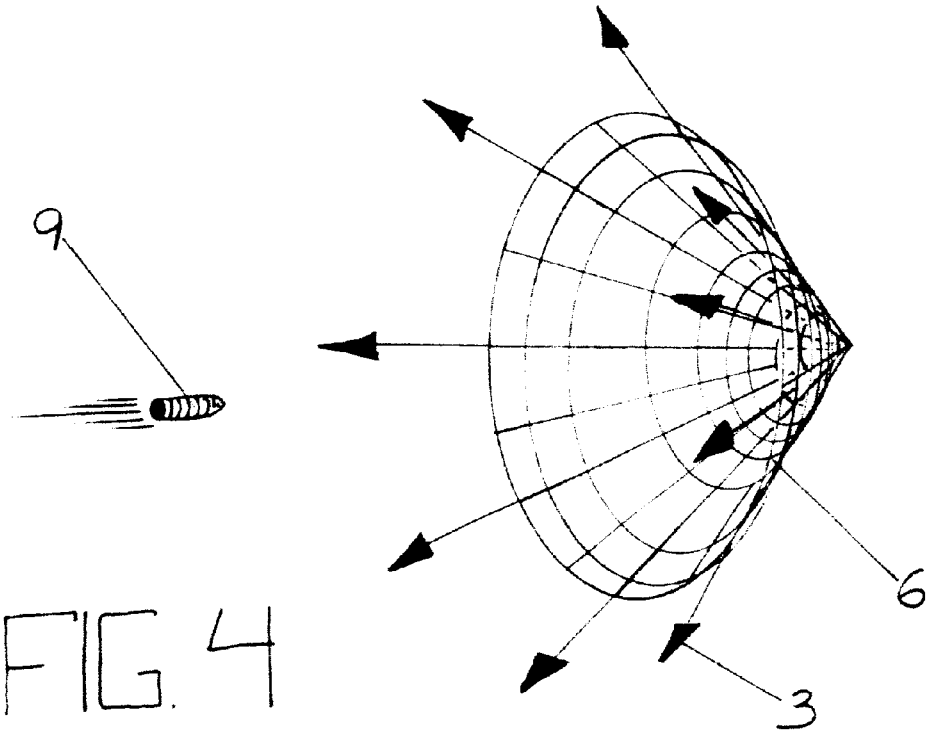
FIG. 4

INTERCEPT VEHICLE FOR AIRBORNE NUCLEAR, CHEMICAL AND BIOLOGICAL WEAPONS OF MASS DESTRUCTION

CROSS REFERENCE TO RELATED APPLICATIONS

Not Applicable

BACKGROUND OF THE INVENTION—FIELD OF INVENTION

This invention relates to an intercept device; specifically a vehicle to obstruct and capture a flying nuclear, chemical or biological weapon, missile, hijacked aircraft or other airborne weapon of mass destruction.

BACKGROUND OF THE INVENTION

The threat of a nuclear attack has been a serious concern of the United States since the Cold War. Although the threat of a planned nuclear attack from the Soviet Union has decreased since the Cold War, several nations have achieved significant technical advances in the fields of nuclear weaponry and other weapons of mass destruction. Consequently, the clandestine development and sales of inexpensive nuclear, biological and chemical weaponry to nations who support global terrorism are a more immediate threat to the security of the United States as such weapons of mass destruction are known to be possessed by numerous nations.

As modern computer aided manufacturing technologies and inexpensive sophisticated electronics become commonplace throughout the world, nations that previously posed no threat to national security now have the ability to design, manufacture and deliver weapons of mass destruction to targets around the world with great speed and precision. Advances in miniature Global Positioning Systems, remote launch systems, encrypted computerized control and guidance systems, satellite communications and propulsion systems all contribute to the availability of manufacturing resources needed to make high tech weaponry. This allows various nations and terrorist organizations the ability to develop, or purchase technologies to develop inexpensive missiles and short range airborne weapons.

Recent advancements in the portability, size, ranges, precision and destructive capabilities of such weaponry has changed significantly. The methods by which a nuclear warhead can be delivered to a target have also changed since the cold war. Short-range, less expensive missiles capable of carrying biological or nuclear weaponry have also evolved as a result of the aforementioned technical developments and have become a viable, affordable method of weapon delivery, even for nations or terrorist organizations with limited budgets. However, ICBM's, or similar space-based and high altitude weapons remain a formidable means of delivery and a viable threat to US National Security.

Recent terrorist attacks against the United States also saw the application of hijacked aircraft as weapons of mass destruction by means of ballistic collision with the World Trade Center. Thus, weapons of mass destruction are now defined in a much broader sense. The attacks of Sept. 11, 2001 confirmed that weapons of mass destruction need not be sophisticated nuclear explosives or ICBM's to impart devastating destruction of American lives and civic infrastructure. Likewise, although conventional, nuclear and biological weaponry still remain a threat, any object with substantial mass and velocity has the potential to be used as a weapon of mass destruction and should be defined as such.

Numerous methods have been devised to launch flying nuclear and conventional weapons from space-based, land based, sea-based and mobile launch systems. Consequently, many methods of defense to protect against such attacks have been developed and patented. Concurrently, many methods of defense to protect against less sophisticated methods of attack, like airliner hijacking, have also been patented. Many of these patents have unique applications that were developed in response to specific threats that no longer exist.

Early in the cold war, intercontinental ballistic missiles held by the Soviet Union had limited ranges and flight capabilities that allowed the US Armed Services and other defense organizations to predict the shortest flight paths, over the North Pole, to the intended target cities in the US. This made missile flight paths predictable, as the shortest paths were known. At this time, even if the Soviets used mobile, repositionable launch systems, such a truck mounted missile launch apparatus, the technology of the era limited their potential launch zones to areas that would allow the missile to reach the continental US. Later space based capabilities allowed missiles to be launched into space to reside in orbit for extended periods of time and be remotely controlled to re-enter the atmosphere to attack a specified location on land. Subsequent improvements since the cold war, to enhance capabilities of both US and Soviet missiles, included numerous improvements in computer guidance systems, propulsion, multiple weapon delivery and communications.

To enhance the long-range destructive capabilities of nuclear warheads carried aloft by Inter Continental Ballistic Missiles (ICBM's), several types of delivery systems and warheads were developed by the US and Soviets. The Multiple Independently Targeted Re-entry Vehicle (MIRV) system allowed a single missile to dispatch numerous nuclear warheads (MIRVs), to separate targets, while in flight. The US experimental rocket powered re-entry vehicle allowed an individual warhead to change its path as it falls. An earlier system, the Soviet-built Fractional Orbit Bombardment System (FOBS), allowed missiles or warheads to remain in orbit, for a period of time, before beginning their decent. FOBS gave the Soviet Union the ability to launch a mass attack against the US from any direction rather than just depending on a ballistic pathway arching over the North Pole. FOBS and similar systems are sometimes described as a "resident orbit systems". Some researchers believe that several nations are developing resident orbit systems that can keep nuclear weapons in orbit indefinitely, until remotely launched for the purpose of a surprise attack.

French Patent number FR-PS 859,282, which comes closest to the object of the present invention, describes intercept devices in the form of net-like structures, which are brought into the flight path of a flying object to be fought, by means of carrier projectile, and are deployed there preferably by means of centrifugal force. For this purpose, small, uniformly distributed centrifugal weights are arranged on the net. According to this patent, the object to be fought (such as an approaching missile) entangles in the net. This patent also notes that the vertical rate of fall of the entangled object can be slowed down, for example, by means of several small parachutes or similar aerodynamic resistance bodies.

Whereas this device can be applied to obstructing missiles or hijacked aircraft, it employs no method of capturing and holding the object to be fought, other than reliance upon an extremely low probability of mechanical entanglement due to aerodynamic turbulence. With that, the object to be fought can escape the net and potentially fall to the ground.

U.S. Pat. No. 5,583,311 describes an intercept device for flying objects formed of a lightweight, small volume, packable structure made of a tear resistant, pliable material which can be stretched to a large two-dimensional or three-dimensional expansion by means of a deployment device. This patent describes such structures as having an integrated method of destruction, like built in explosives that destroy the deployable structure without destroying the aircraft that has been intercepted. The object of this invention is to slow the aircraft by means of aerodynamic drag, then release the aircraft by breaking the cables that comprise the intercept structure. However, this invention does not account for the presence of jet engine intakes, propellers, antennas, ailerons and numerous aircraft features that can serve to destroy the capture device and cause the destruction of the aircraft in many other ways. Furthermore, if an aircraft is hijacked to be used as weapon of mass destruction, the described drag devices provide no means of capturing the craft in a manner that provides for a more controlled decent to bring down the craft in an area away from population centers to minimize damage. Likewise, this invention is designed to slow the progress of a large flying machine such as an airplane and does not provide for the capture of smaller, high speed weapons, such as an inbound MIRV warhead, cruise missile or short range surface-to-surface missile.

In European Patent number 175,914, Heinz Piccolruaz describes a relatively flat accordion-like structure that is deployed from and dragged behind an airborne device to act as an obstruction to various large airborne threats such as helicopters. The large surface area of the accordion like lightweight structure is deployed above a helicopter within range of the vacuum created above the helicopter blades. The structure is designed to disable an attacking helicopter by inflicting severe rotor damage as the lightweight structure is drawn into the rotors to cause entanglement and mechanical failure via overloading and breaking the rotor linkages. Piccolruaz also teaches similar methods of destruction that employ parachutes that are drawn into, and collide with, helicopter blades. A third structure described by Piccolruaz deploys a three dimensional network of cables, that are pulled tight by means of weights attached at certain points on the cable network, that are ejected from a flying device. Whereas all three of the methods taught by Piccolruaz are effective in stopping helicopters, they would not have such an effect on a high speed airborne weapon such as a cruise missile, MIRV or hijacked commercial airliner as they do not employ methods to capture and hold an object to be fought in a device that is connected to aerodynamic resistance bodies. Furthermore, all devices described by Piccolruaz require deployment by a flying device (such as a conventional aircraft) that is flown directly and precisely into the path of the object to be fought. At the time this patent issued, the technology for guiding an automated aircraft or missile did not exist.

U.S. Pat. No. 2,365,778 describes a mobile device for repelling the attack of enemy aircraft. This device uses numerous lighter-than-air balloons that suspend a network of cables and similar objects that can effectively become entangled in airplanes' propellers. These balloons are anchored to and deployed from a network of train cars. This idea was developed to protect large buildings from aircraft attacks during wartime, preferably by having a perimeter of train track around a city, so that the balloons could form a protective perimeter. High winds may also defeat the effective use of this invention.

Whereas this method of obstruction is capable of obstructing the path of a large aircraft, it lacks a method of capturing and containing a small weapon that moves at a high rate of speed. This system also lacks the capability to be rapidly and precisely positioned in front of an airborne threat such as a MIRV or small missile, as this invention was developed at a time when such complex and formidable threats were not readily available. Limitations to this invention's mobility significantly limit its effective defensive area. Consequently, this invention would not be effective for stopping a hijacked commercial airliner, missile or other high-speed airborne threat. The arrival time, speed and direction of such a threat is not known in advance of a hijacking, or surprise missile launch, to allow proper time for setup of the countermeasure described herein.

Several modern missile defense systems under development by branches of the US Armed Services and Department of Defense have many unique defensive properties that more appropriately address the threat of high speed flying objects that are, or can be used as, weapons. However, the effectiveness of these systems is heavily dependent on their applications.

The majority of high altitude missile defense systems under development and in use utilize an armed projectile that is intended to strike and destroy the inbound weapon such as a MIRV, cruise missile, ICBM, guided missile or airplane. Some projectiles are explosive, while other projectiles rely only on their kinetic energy to destroy an incoming nuclear weapon via collision.

Systems that rely on collision with the incoming weapon are called "hit to kill". These systems, that use the motion and mass of a kill vehicle to strike an incoming weapon, are currently under development for upper tier (high atmosphere and space based) missile defense systems. Examples of high tier systems are the US Navy Theater Wide Missile Defense System, Theater High Altitude Area Defense (THAAD) system and the TRW and Raytheon ballistic missile defense systems discussed in the cited prior art article by Theodore Postol.

Other systems, such as the Patriot missile system used in the Gulf War, use blast-fragmentation. In a blast-fragmentation system, high power explosives detonate shortly before the collision of the interceptor and threat. This causes the airborne threat to be destroyed by an explosion and subsequent debris field of shrapnel in its immediate flight path. The explosion also causes a destructive shock wave that mechanically and electrically destroys the airborne threat, and/or renders its electronic systems useless. These blast fragmentation systems are popular for lower-tier defensive applications.

Both blast fragmentation and hit-to-kill systems for use in upper and lower tier defensive applications use an (interceptor) missile to destroy an incoming (threat) missile. This requires a highly sophisticated and accurate control and guidance system. Such a control system must be capable of tracking the three-dimensional speed and direction of both the incoming threat and outbound interceptor simultaneously. This allows computers to coordinate the proper flight path and speed, in real time, to ensure that the interceptor intersects the threat with full contact to destroy the threat. Any minute deviation in the course of the interceptor can cause the interceptor to fly right past its intended target.

To track threats with such precision, lower-tier systems employ multiple ground radars combined with other tracking resources such as planes, ships, mobile land units and fixed land units. These low tier shorter-range missile defense systems, like the Patriot, have experienced success in both testing and real applications such as the Gulf War.

However, tests on upper tier missile defense systems have been far less promising. The complexities of this system are explained best by in the article entitled "Why Missile Defense Won't Work", by Theodore A. Postol in the April 2002 issue of MIT Technology Review. With both hit-to-kill or blast fragmentation systems, the electronic information that allows for the intersection of the threat and interceptor must be absolutely flawless. No deviation or error is acceptable, as it would cause the outbound interceptor to miss the inbound threat. The article by Postol describes numerous flaws of the National Missile Defense effort. Specifically, Postol discusses the Raytheon-built exoatmospheric kill vehicle, the current state-of-the-art hit-to-kill system, designed to locate, track and collide with a nuclear weapon deployed from an ICBM in the upper tiers of the atmosphere.

However, current technical limitations, such as the maximum image resolution of current missile tracking radars, vulnerabilities of infrared tracking systems and the adverse operating environments posed by space cause problems. The Raytheon exoatmospheric kill vehicle is easily confused by inexpensive, simple decoys that can be deployed with actual nuclear warheads by an intercontinental ballistic missile traveling in space. Likewise, tests of the exoatmospheric kill vehicle indicate that such primitive decoys such as colored metalized balloons and inexpensive cone shaped decoys adequately confuse the target acquisition systems of the current National Missile Defense systems that use the state of the art Raytheon exoatmospheric kill vehicle.

The flaws related to the National Missile Defense efforts reported by Postol are supported by reports in USA Today, the Wall Street Journal and other publications that published the failures of the THAAD system in similar tests. The Theater High Altitude Area Defense (THAAD) system is an upper tier, land-based defense system with long range and high altitude intercept capability. THAAD consists of four principal elements: truck-mounted launchers, interceptors (missiles), radar and a battle management control system that handles communications and intelligence. As of Sep. 18, 1999 THAAD had 8 operational tests. During five of these tests the interceptor did not strike the threat as planned, seemingly due to the overwhelming complexity of this system. Like most systems, THAAD relies upon the precise intersection of the threat and interceptor.

Accordingly, patent number 5,710,423 describes an exoatmospheric missile intercept system employing tandem interceptors to overcome unfavorable sun positions. Just as numerous decoys have been devised to thwart US missile defenses by confusing the NORAD long range stereoscopic infrared detection and tracking systems, the sun also confuses these systems by blinding them. This flaw leaves US defenses vulnerable to any weapon that approaches from or through a pathway that forces infrared detection systems to point toward the sun. Likewise, this patent addresses one way to track an enemy missile outside of the atmosphere even if remote detection systems are blinded by the position of the sun, and temporarily unable to track the enemy missile. However, even with two interceptors, this system still relies upon a precise collision between and interceptor and the threat.

Other US Government proposed anti-ballistic missile defense systems utilize Airborne Laser systems. High power lasers mounted within the cabin of a modified jetliner, usually a Boeing 747-400F, can be pointed to destroy an enemy missile shortly after launch. This system also serves as a deterrent since it is potentially capable of destroying a missile so shortly after launch that the weapon will fall back on to the territory of the enemy who launched it. Such laser systems utilize several laser modules to create a megawatt-class chemical laser. This laser is fired from an aperture at the front of the plane, housed within the nose cone. Smaller scale models of numerous laser-based systems have been tested, although none are known to be in operation. Furthermore, such systems require that the aircraft be in flight at the time that a nuclear (or other) weapon is launched. These systems, and many of the aforementioned systems, require prior knowledge of a pending launch of a weapon.

Whereas all of the described systems have unique advantages, all have several large disadvantages. All of the systems described require time to set up, coordinate and deploy. Some systems, like the proposed Navy Theater Wide, use the inherent mobility and 24 hour readiness of the US Navy; this allows for a near instantaneous response if such war ships are present in, or within range of, the conflict area. However, the deployment of these systems require prior knowledge of a conflict, with advanced planning that leads to the deployment and assembly of such systems in conflict areas that anticipate missile attacks. The assembly of such sites sometimes takes a few days. The Airborne Laser System, with it's proposed superior range and accuracy, cannot be effective if it is not flying; and to keep such a system airborne for long periods of time is expensive and requires extensive coordination and staff both in service and when the plane is on the ground.

A disadvantage of all of the systems is setup and response time. Whereas many of these systems could be placed on active duty with prior warning of an escalating conflict, many are useless against a surprise attack. An unannounced, unanticipated missile attack from a submarine or other means, could place a nuclear weapon or MIRV on course to a US mainland target with little time to respond to and destroy the incoming weapon. During an anticipated conflict the deployment of several defense systems does not totally guarantee that a missile threat will be neutralized at a safe distance from civilians, military personnel or property.

The high degree of accuracy needed to cause an interceptor to strike a threat is the equivalent of shooting a bullet out of the sky from a distance of several hundred miles. Although it can be done, current tracking system limitations cause such systems to be unreliable. As if the technical limitations are not enough of a problem for upper-tier defense systems, inexpensive decoys among other problems detract from the reliability of such systems.

Furthermore, there are also many problems with modern methods of lower-tier interception. A long-range missile can deploy several weapons that fall to mid or lower tiers of the atmosphere. A cruise missile, surface to air missile or less expensive weapon could place the path of a flying weapon close to the ground. Hijacked aircraft, large or small, would also fit into this category as a lower-tier ballistic weapon of mass destruction. Demolishing individual weapons with a ballistic collision or blast-fragmentation in the lower tier of the atmosphere weapon may release a cloud of radiation, biological agents, chemical vapor or other deadly particles if the weapon contains such substances. Likewise, destroying an aircraft requires the difficult decision to take human lives in order to save others. However, destroying an aircraft with a missile does not guarantee that large pieces of debris will not cause significant damage to populated areas below. Accordingly, the invention described herein will address a possible solution to these problems.

Another problem not addressed by the prior art is that the destruction of a weapon in flight leaves minimal evidence to identify the weapon manufacturing technology of the enemy. This leaves little ability to ascertain (by disassembly and parts analysis) what nations are selling weapons or (weapon) components to the nations or organizations who are using such weapons. The invention disclosed herein will address a solution to this problem.

In short, numerous ballistic missile defense systems that are currently in use or under development are prone to failure due to technical limitations and the extreme degree of accuracy needed to ensure that a threat is destroyed. Furthermore, some threats, such as biological, chemical or hijacked aircraft threats may require a "softer" method of defense instead of the traditional destructive means.

BACKGROUND OF INVENTION—OBJECTS AND ADVANTAGES

Accordingly, the system I have invented is capable of obstructing the flight path of a weapon of mass destruction like a MIRV, guided missile, cruise missile or hijacked airliner.

The broad range of capture capabilities described herein is based on the cobweb-like drawstring action web that contracts around a captured object by using tension created by inertia provided by the perimeter masses and aerodynamic drag supplied by parachutes or similar structures. Such a design can be scaled to fit numerous military applications, hence it's versatility in capturing a broad array of threats, of many sizes, in the atmosphere or in space.

An example of a small system may employ webs that are only a few yards across that require minimal launching systems. Such small systems could be used to defend a small airfield or troop position against portable short-range missiles or surveillance drones launched by enemies.

A system with a much larger web could be used as a high altitude missile defense system to capture MIRV's or other high altitude weapons in the upper atmosphere. For this application a large web, such as one 300 to 500 feet in diameter, up to several miles in diameter, could deploy into the approximate path of a threat to capture it. Furthermore, unlike existing systems, the web would not require a pinpoint precision intersection between the object to be fought and the intercept vehicle; a collision anywhere within the web's perimeter would initiate a successful capture. This allows for a successful capture (of an ICBM or MIRVs) even if slight error is present in the trajectory of the interceptor as it is flown into position by a boost vehicle (such as the one described in U.S. Pat. No. 5,811,788). Likewise, there would be a very high probability of successfully capturing a weapon when such a large web is used. As an added advantage, large webs for high altitude missile defense could also be outfitted with means to destroy the threat after it is captured.

Such large webs could also be used to capture and parachute to the ground a hijacked airliner or enemy aircraft that must be obstructed but preserved with as little destruction or damage as possible. Whereas wing breakage and other damage would be inevitable with this application, a web with many closely connected high strength fibers would likely retain many large and medium size pieces of the damaged airframe.

This unique ability to capture weapons or aircraft in flight could be used to capture an enemy fighter plane, surveillance drone, missile, bomb or other weapon for the purpose of disassembling and analyzing the captured weaponry. This would allow the US to ascertain the enemy's technical capabilities or the origin of manufacture of the airborne weapon and it's components. As this same interceptor can be used in the upper atmosphere, it could be launched to capture falling space hardware or other flying objects that are difficult to identify at great distances.

Likewise, this "softer" method of obstructing and capturing high-speed airborne weapons also gives US the ability to capture airborne biological or chemical weapons without exploding them. Destroying such toxic weapons in midair, by conventional means, may release toxic contents. (This is a major drawback of the current Patriot Advanced Capability system and similar Israeli systems).

The invention that I have described details the hardware needed to capture a chemical, biological or nuclear weapon in mid-flight and float it slowly to the ground. Likewise, many inexpensive or older weapon delivery systems, such as ones used in Iraq, depend on a hard collision with the ground in order to detonate. Many current Iraqi chemical weapons and biological weapons use such impact-dependent detonators. It is believed that many nations developing nuclear weapons may use inexpensive casings with impact-dependent detonators to deliver these nuclear weapons. The present invention allows for a way to capture, slow and land such weapons without a hard collision with the ground, therefore reducing the risk of an explosion. Upon capturing such weaponry, it can be disarmed, disassembled, it's parts photographed, cataloged and confiscated for US defense intelligence organizations and then used as evidence of wartime international law violations if needed.

Such a system with the capabilities to stop, delay or reposition a weapon of mass destruction also allows the existing US missile defense systems more time to detect and track and destroy the threat, as needed, using conventional weapon systems that are already in use. Likewise, the described invention is capable of causing a delay substantial enough to allow the US defense systems an extra margin of time to launch multiple strikes against the incoming threat in the event that initial attempts to destroy the threat fail.

The invention described herein allows a small fast moving weapon to become a large, slow moving target that can be easily destroyed, by existing missile defenses or other means, as is descends slowly using large parachutes.

Alternative uses of the system described herein include applications for space defense and the de-orbiting, removal or capture of space hardware for military or commercial applications. Regardless of the space application, the deployable resistance structures for a space type capture would be structures not dependant on atmospheric drag to capture and slow the object to be captured or obstructed. A plurality of small rockets or similar methods of providing resistance could be used. If the object to be captured and the net that it will collide with has a high closing velocity, simple perimeter masses may indeed be enough to initiate the drawstring capture as a result of the high velocity of impact and the inertia of the perimeter masses. This could be used to capture an orbiting object and increasing it's overall mass in order to change the object's orbit by simple physics, without complex or expensive energy sources, such as rockets.

For applications where space capture and controlled de-orbit are necessary, various types of deployable resistance bodies appropriate for slowing the object captured in space, withstanding atmospheric re-entry and providing atmospheric drag after re-entry may be necessary to coordinate a full capture and de-orbit maneuver. Such applications may be useful for capturing and de-orbiting space debris, small meteors or space junk that comes too close to spacecraft or space stations or for the covert capture and confiscation of space-based hardware used by enemy nations. Consequently, this could also serve as an inexpensive way to de-orbit our own spy satellites, communications satellites or other hardware if such hardware becomes damaged, outdated or otherwise un-useful.

Extremely large net systems (500 feet to over one mile in diameter) could be applied in space as an early intervention system for stopping a ballistic missile in space before or shortly after it's MIRVs have deployed. As cited in the article by Postol referenced in the prior art, many nations are planning to equip their ballistic missiles with decoy MIRVs that effectively confuse the current interceptors used in the test programs for national missile defense. Likewise, since the real MIRVs and decoys move at the same speed through space, and are often deployed together, a large net could obstruct the path of all MIRVs deployed by an ICBM, both real and decoys. Once all or most of the deployed MIRVs are captured within the net, the existing missile defense networks, and variations under development could be employed to launch conventional measures, such as a Raytheon exoatmospheric kill vehicle to hit the net that contains several captured MIRV's, thus increasing the chances of destroying the nuclear weapons while they are still in space. Concurrently, a large scale net that captures many MIRVs at once would likely impart substantial damage to the real MIRVs when the drawstring closure collides all of the (decoy and real) MIRVs together to capture them within the net. This would create one large, slower moving target for US defenses to more easily destroy.

Further objects and advantages of the described invention will become apparent from a consideration of the drawings and ensuing description.

SUMMARY

The present invention is an intercept device having a foldable, flexible web like structure, of cobweb like form. The perimeter of the web preferably has three or more uniformly distributed masses. These masses contain deployable aerodynamic resistance bodies. The masses forcefully separate causing the expansion of the web into the approximate path of a threat in the atmosphere. The deployment of the web causes a collision between the threat and the web. Upon such a collision, the inertia of the masses causes tension, forcing the web to distort around the threat that it has collided with. Just after the collision, aerodynamic resistance structures deploy from the perimeter masses. This places extreme tension on drawstring-action sections of the web causing rapid contraction of the web and subsequent web closure around the captured weapon. In essence, the web contracts in the same way that a drawstring trash-bag contracts when the bag's handles are pulled with force. Hence, the drawstring action of the web captures the threat in the web, and holds it securely, as aerodynamic resistance structures maintain tension on the drawstring elements.

The faster or more massive a threat, the more closure force will be exerted to capture and slow the threat by the drawstring action of the web. Inertia from the perimeter masses and aerodynamic drag from resistance bodies (like parachutes) are used to capture, slow and hold the threat (missile, MIRV, hijacked airliner, fighter jet, etc.) so that it floats slowly to the surface.

Variations of this system for space applications would use resistance structures not dependent on the presence of air to create drag. Instead, rockets or similar propulsion could be used to capture and de-orbit a space-based threat to land it in a safer location to minimize damage or loss of life.

DRAWINGS—FIGURES

FIG. 3 shows a small charge 5 detonating, pushing perimeter masses 3 outward, connected to the web 6.

FIG. 4 shows the interceptor where the forceful separation of several masses 3 have pulled open the web 6 to it's fullest expansion, in the path of an enemy flying weapon 9. Web 6 is cone shaped due to assumed aerodynamic resistance and motion toward weapon 9.

Figure 5:
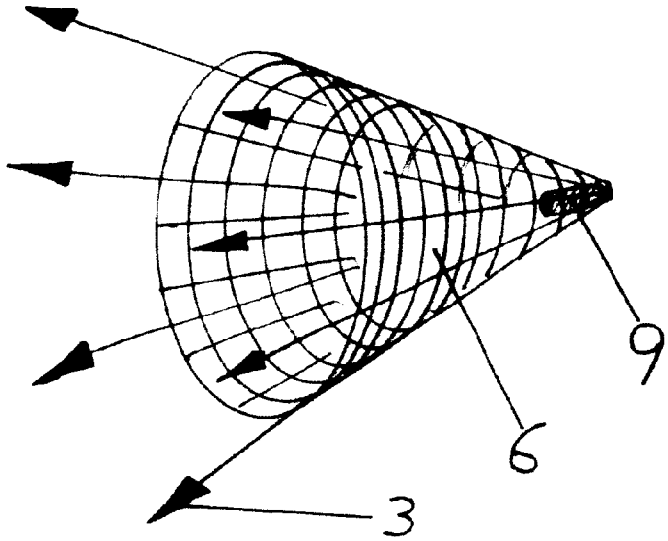

FIG. 5 shows weapon 9 colliding with net 6, causing extreme tension on net 6.

Figure 6:
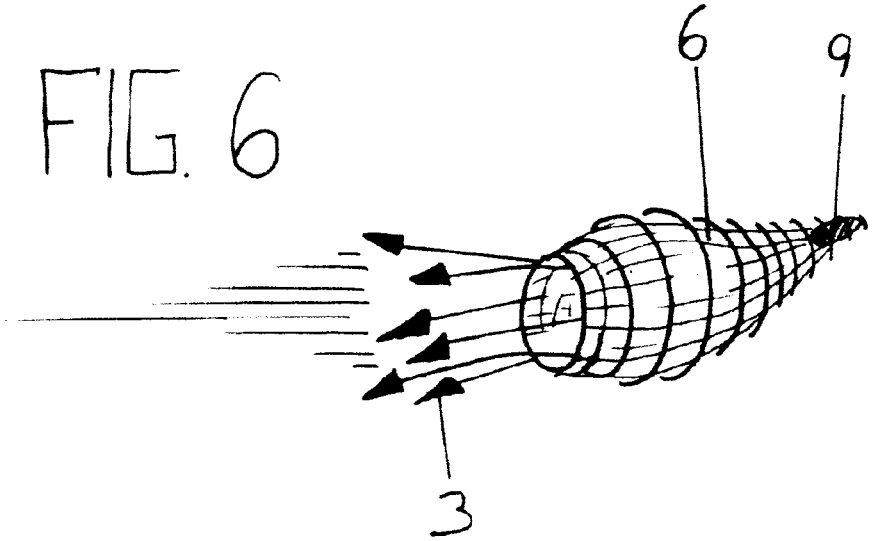

FIG. 6 shows the inertia of masses 3 pulling on the web 6 against the direction of travel of captured weapon 9 to initiate drawstring-action closure to web 6.

Figure 7:
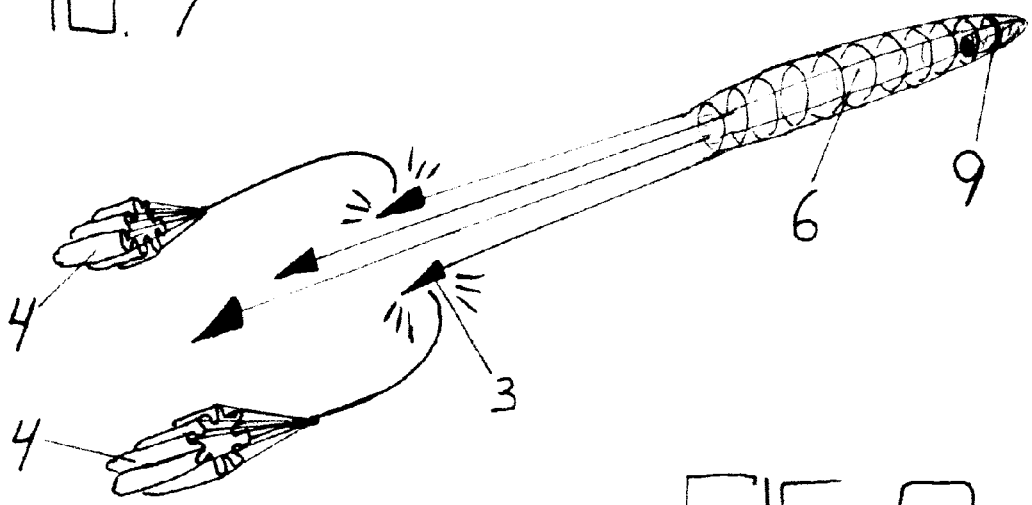

FIG. 7 shows parachutes 4 being deployed from two of the perimeter masses 3, causing severe tension on drawstring-action sections of web 6, causing forceful closure of web 6 around captured weapon 9.

Figure 8:
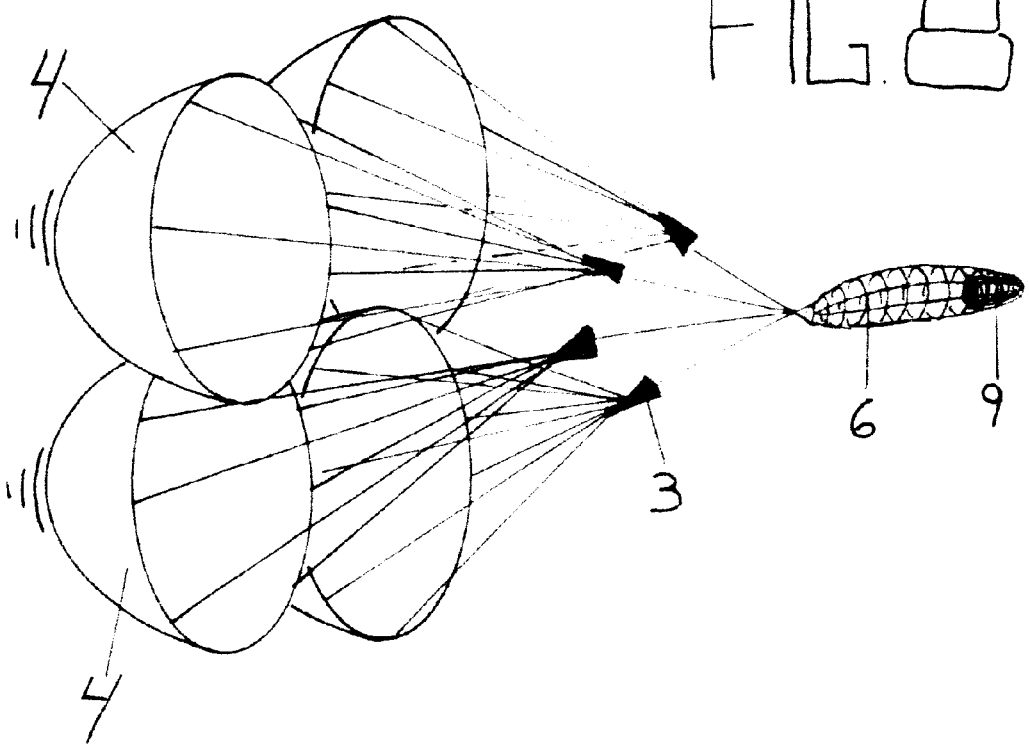

FIG. 8 shows parachutes 4 fully deployed and slowing weapon 9 by holding steady tension on drawstring-action sections of web 6.

DRAWINGS—Reference Numerals

1 interceptor
2 Launch vehicle
3 Perimeter mass
4 Deployable aerodynamic resistance structures (parachutes)
5 Small explosive charge
6 Web
7 Connection points on web
8 Space for web within assembly of perimeter masses
9 Flying weapon of mass destruction

DETAILED DESCRIPTION

Figure 1:
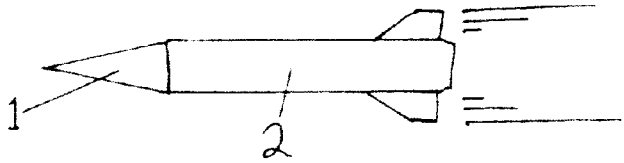
FIG. 1 shows the interceptor 1 mounted to a launch vehicle 2.
Figure 2:
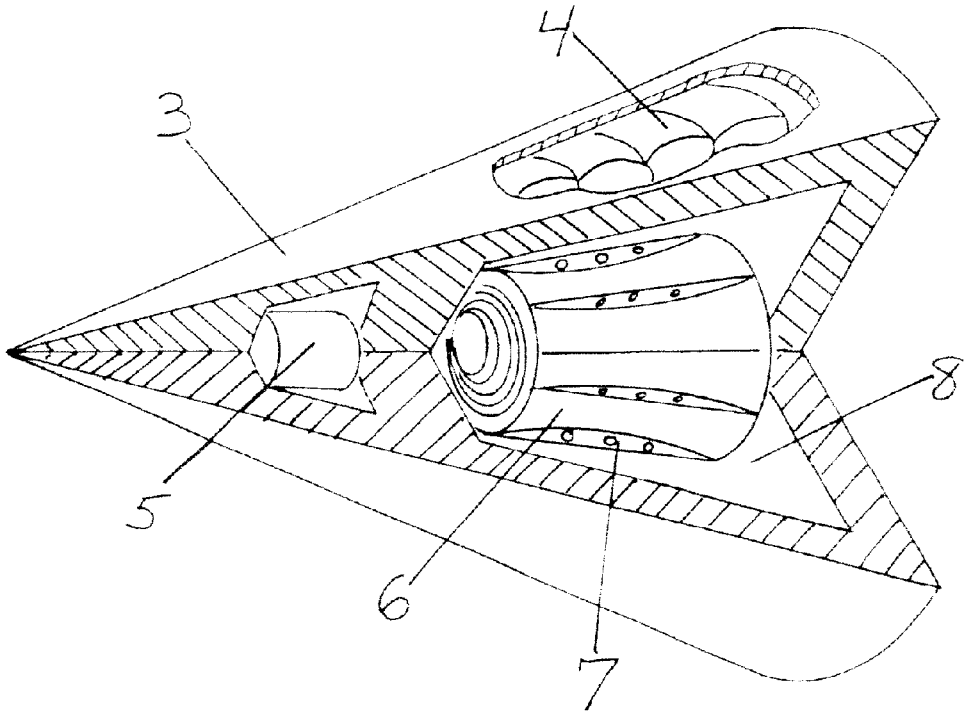
FIG. 2 shows the interceptor 1 as a cutaway drawing to illustrate an internal configuration of the intercept vehicle. The case of the interceptor is comprised of the perimeter masses.

Illustrated in FIG. 1, an interceptor 1 is connected to or part of a conventional launch vehicle 2. A launch vehicle 2 is responsible for the propulsion, guidance and delivery of the interceptor to its intended location; into the path of a flying weapon. A launch vehicle 2 can be a conventional rocket, missile, cruise missile, manned or unmanned aircraft or other appropriate flying machinery. It is assumed that launch vehicle 2 has a means of separating or dropping it's booster stages to not obstruct the operation of interceptor 1.

Interceptor 1 is preferably comprised of three or more evenly distributed masses 3. These masses 3 contain integral packable, deployable aerodynamic resistance structures 4. The masses are attached to the perimeter of a large, flexible, packable web-like structure 6 (similar to a spider web) via a means of connection 7.

Web 6 is packed within the interceptor 1 so it can rapidly be drawn open to form a two-dimensional or three-dimensional shape similar to a large spider web. The web can be drawn open by any appropriate means such as centrifugal force, rockets or an embedded explosive 5 that propels the masses 3 away from each other evenly. Such a web 6 can be made from numerous polymeric fibers and combinations thereof. Kevlar™ brand high strength aramid by DuPont, fiberglass mesh, carbon fiber and lightweight metal or polymer screening can be combined to form a lightweight strong polymer web 6 that can resist such extreme stresses of ballistic collision.

Web 6 has integral means of contraction via drawstring-action and means to activate such contraction only after it's deployment and subsequent collision with an airborne weapon.

Integral means of contraction of web 6 are controllably coupled to masses 3 by a means of connection 7 to allow force of inertia from masses 3 a path to create tension to pull and activate drawstring closure action of web 6 only after a collision with a weapon.

A plurality of deployable masses 3 contain tightly packed, flexible, expandable, deployable aerodynamic resistance bodies, such as parachutes 4. Masses 3 that hold parachutes 4 in packed position contain integral method of releasing parachutes 4 upon sensing collision with a weapon 9. Upon sensing this collision, parachutes 4 release from packed position to create extreme aerodynamic resistance.

Parachutes 4 have sufficient aerodynamic resistance to slow the weapon 9 that has collided with the net 6 and subsequently pull drawstring cable sections of web 6 with adequate force to cause them to rapidly shorten the circumference of expanded web 6, closing it around weapon 9.

In the preferred embodiment, the interceptor 1 has means to allow the drawstring closure action to occur only after a collision with a weapon 9. This prevents premature activation of the drawstring closure action of web 6.

One means of timing the drawstring closure to avoid premature activation is to use locally severable fibers at numerous locations on web 6. These severable linkages should have sufficient strength to prevent premature drawstring closure after the web has expanded, but before collision with a weapon. The combined strengths of all severable linkages should be weak enough to break rapidly and allow the rapid drawstring closure of the web instantly upon collision with a weapon.

However, breakable fibers are just one means of properly timing the closure action. Other means can be electromechanical mechanisms, miniature explosive joints or other means to facilitate precise drawstring closure action only upon the web's collision with a weapon.

OPERATION OF THE INVENTION

Interceptor 1 is mated to, or built with an integrated launch vehicle 2. The launch vehicle 2 can be, but is not limited to, any conventional method of launching a payload such as re-usable rocket, expendable rocket, manned or unmanned aircraft, cruise missile, submarine launched missile, ship launched missile or spacecraft. If interceptor 1 and launch vehicle 2 are substantially large, it is presumed that launch vehicle 2 may separate or release boost phases to assure the proper performance or guidance of interceptor 1 into it's intended position.

Launch vehicle 2 contains a guidance system and method of steering interceptor 1 into the path of a threat, such as an incoming nuclear weapon. Such guidance systems are employed on numerous aerospace and defense products available from Raytheon, Lockheed Martin, Boeing and Hughes.

Once the interceptor is located within close proximity to the threat, the interceptor 1 must fully deploy its web 6 with enough time before collision with a weapon 9.

Hence, a method of deployment such as centrifugal force, rockets or explosives 5 are used to forcefully eject masses 3 away from each other (breaking up the interceptor into it's constituent masses 3). The inertia of the masses 3 pull web 6 outward to form a large web shaped barrier in the direct path of weapon 9 to be obstructed and captured.

The approximate center of web 6 is struck by weapon 9. Inertia from momentum of masses 3 pulling against web 6 and weapon 9 activates means of initiating the drawstring closure action. One method to time the closure action to correspond with impact of weapon 9 could be the use of locally breakable fibers. This causes drawstring action to contract web 6 around weapon 9. Almost instantly after collision, parachutes 4 (or similar aerodynamic resistance bodies) deploy from their packed, folded positions in masses 3 to create extremely high drag. The aerodynamic drag created by parachutes 4 exerts tremendous force pulling on integral drawstring sections of web 6; this increases the force of the drawstring closure action that started upon collision with weapon 9 (due to inertia of masses 3). Combined energies caused by inertia of masses 3 and aerodynamic drag of parachutes 4 forcefully contract web 6 around weapon 9 while the weapon is still moving. This drawstring action that contracts web 6 around weapon 9, traps the weapon and prevents it from falling out of the web. The drag created by the parachutes 4 eventually slows the forward motion of the weapon 9. As the captured weapon slows, the tension on drawstring sections of web 6 is maintained by the force of gravity pulling against the resistance of the parachutes 4, through masses 3 and connecting members 7. The captured weapon falls slowly to the ground.

Depending on the size and number of parachutes and mass of the weapon(s) captured, the time that the weapon stays aloft may vary, allowing the authorities ample time to destroy the trapped weapon with conventional or other armament if destruction is warranted. If the use of the capture system is for capture only, various signal devices such as strobes, radio beacons, satellite communication systems and GPS locators can be present aboard the interceptor to allow authorities to electronically monitor the location of the deployed interceptor and the captured object.

DESCRIPTION AND OPERATION OF ALTERNATIVE EMBODIMENTS

Numerous variations of this interceptor can be manufactured to intercept weaponry or airborne devices of numerous sizes and shapes. Overall diameter and materials selection for the web depends on the total mass and speed of the object or objects to be intercepted. Likewise, the notion of a web is only one preferred embodiment. The packable, deployable, web-like structure can be made from numerous thin, flexible, deformable materials such as ballistic grade fabrics, aramids and other composites. Parachutes and other devices for aerodynamic drag may vary substantially depending on the size and shape and anticipated speed and mass of the object(s) to be intercepted.

Alternative uses for the invention in its preferred embodiment include the emergency interception and recovery of disabled aircraft and spacecraft. Likewise, the invention can be used for the interception of space debris or satellites that fall from orbit and pose a threat to inhabited areas.

One alternative embodiment is a similar interceptor used for space applications. In cases where the interceptor is used outside of the atmosphere, parachutes are eliminated, as they are useless in the vacuum of space. Small interceptors carried aloft by spacecraft, or parked in resident orbit can be used to steer orbiting weapons of mass destruction off course, and away from the earth. If substantial power is needed to perform such a task, parachutes can be replaced with small, remotely activated disposable rockets to assist in the movement of the captured device. Likewise, small interceptors can be used to de-orbit inoperable satellites or space debris at a trajectory that assures no harm to inhabited areas by falling space debris.

Another variation of the invention can employ a linear ratchet mechanism (similar to that on a nylon wire tie) within the drawstring contractable web structure. This would allow a web to contract around an object to be captured without the possibility of the drawstring coming loose (and releasing the caught object) from a change in, or lack of, tension due to parachute failure or other problems. This variation would also work well in space where the linear ratchet feature could be used to capture, de-orbit or increase the total mass of a piece of space hardware by use of a web intercept system without retrorockets or without similar devices that would normally replace the missing parachutes. With a linear ratchet variation, the inertia of the masses would cause the drawstring contraction, but the contraction would not be reversible. The web could only get tighter, but not looser. This would be a significant advantage where aerodynamic drag and gravity are not present, or unreliable, such as space or the upper tier of the atmosphere.

Furthermore, small nations such as Iraq, who are known to posses weapons of mass destruction, often rely on older, less sophisticated weapon delivery systems. Some of these delivery systems are traditional metal bomb cases or older missiles that must physically collide with their target in order to detonate to release chemical or biological agents, or conventional explosives. The invention described herein offers a "softer" method to obstruct and delay the arrival of such biological and chemical weapons by capturing weapons in mid-flight, without activating their impact dependent detonators. To properly engineer a web to capture weapons without detonating them, the amount of G force, resulting from collision of a weapon with the web, must be carefully considered. The design of the web can be varied and compensated for the anticipated approximate mass of the weapon (to be captured) based on numerous interceptor design parameters, and the addition of shock absorbing members. Parameters such as web material, diameter, interceptor speed, shape and size of resistance bodies (such as parachutes) and the presence or absence of shock absorbing linkages between critical load bearing members can serve to distribute weapon deceleration over time, as needed, to completely prevent the detonation of some weapons. In cases where interceptor design is appropriate, chemical, biological and conventional weapons can be captured in mid-flight and parachuted to the surface without detonation.

This soft-capture technology would likely be very effective against aggressors who use inexpensive, easy-to-build and readily available impact dependant detonators to explode nuclear, biological or chemical weaponry.

This, again, allows the US to capture whole, un-detonated weapons, planes, space hardware or technology products from other nations to analyze their capabilities and add such information to the knowledge of US national security organizations that protect the US from aggressors. The ability to capture such weapons in whole, un-detonated form would allow the US to develop, in secret, military countermeasures against such weapons.

Likewise, captured chemical or biological weapons could be analyzed to identify specific strains of bacteria, viruses, or hot agents and compare such biohazard agents to known strains. This may lead to better identification of sources of bio-hazardous agents if the strains from a captured weapon positively match strains developed in certain nations, or stolen from specific US research facilities.

CONCLUSION, RAMIFICATIONS AND SCOPE OF INVENTION

Thus the reader will see that the interceptor described herein provides a means of obstructing and capturing weapons of mass destruction from travelling on their intended courses. Unlike all of the systems currently in use and under development, the system described herein allows for a capture of an airborne weapon even when there is error present in the trajectory path to intercept the weapon. Due to the scalability of the web design, an airborne threat, such as a nuclear weapon or MIRV, approaching a large net has a high probability of being effectively intercepted and contained even if it fails to strike the absolute center of the web. Such probabilities increase with the size of the web. No existing missile defense systems have such a feature, as numerous "hit-to-kill" and "blast fragmentation" systems are ineffective if they fail to intersect with their target perfectly.

The interceptor described herein allows the armed forces more time to respond to such a threat when this interceptor is employed, as the time it takes for an intercepted weapon to reach the surface is greatly increased. The described interceptor turns a small fast moving weapon into a large, slow moving target that can be easily neutralized by existing missile defense systems or other conventional means. Furthermore, due to the unique design of the web as a capture mechanism, it allows for the capture of multiple MIRVs and MIRV decoys if used in space or the upper-tier of the atmosphere.

Subsequent unique applications such as a low-cost de-orbit and space hardware capture system allow the described interceptor to have multiple roles in both military and commercial applications.

Counter-terrorism advantages include the capability to capture and parachute hijacked aircraft to stop a potential disaster without the use of missiles or destructive weaponry to destroy the hijacked airplane. Subsequent space-based counter-terrorism applications of the described interceptor to capture and contain satellites placed in orbit by nations who intend to use such space hardware against the United States further enhances the national security capabilities of the United States.

Furthermore, the present invention has the ability to capture airborne weapons and aircraft with minimal damage, and prevent the airborne detonation of some weapons of mass destruction. Such capabilities would give the US an unprecedented ability to seize enemy weaponry, aircraft and hardware to ascertain where it is made, determine it's level of sophistication and develop countermeasures to increase US national security.

While my above description contains many specificities, they should not be construed as limitations on the scope of the invention, but rather as an exemplification of a few preferred embodiments thereof. Many other variations are possible such as, the interceptor can be manufactured in numerous sizes and shapes, and from numerous materials, in order to capture a multitude of flying or falling objects from various launch platforms under a multitude of conditions.

I claim:

1. An intercept vehicle comprising:

(a) a flexible, packable, deployable web-like structure with means of post deployment contraction by means of drawstring action, (b) a plurality of masses connected to the perimeter of said web-like structure, (b) a means of controllably coupling momentum of said masses to contract said deployed web-like structure around a destructive flying object upon collision of a destructive flying object against said web-like structure, (d) said masses contain activatable means of slowing said contractable web-like structure and said destructive flying object, Whereby the tension produced by the inertia of said masses contracting said web around said destructive flying object upon collision, combined with the tension produced by the activatable means of slowing said web and entangled weapon, create forceful web contraction to capture, forcefully hold and drastically slow the velocity of said destructive flying object.

* * * * *